United States Patent [19]

Teves

[11] Patent Number: 4,856,519

[45] Date of Patent: Aug. 15, 1989

[54] SOUND GENERATING PACIFIER

[76] Inventor: Leonides Y. Teves, 623 - 39th Street West, Bradenton, Fla. 33505

[21] Appl. No.: 149,368

[22] Filed: Jan. 28, 1988

[51] Int. Cl.[4] ..... A61J 17/00

[52] U.S. Cl. ..... 128/360

[58] Field of Search ..... 128/360, 359

[56] References Cited

U.S. PATENT DOCUMENTS 4,554,919 11/1985 Hubert ..... 128/360

4,768,510 9/1988 Leung ..... 128/360

*Primary Examiner*—John D. Yasko

*Attorney, Agent, or Firm*—Frijouf, Rust & Pyle

[57] ABSTRACT

A sound generating pacifier for use by an infant which comprises a pacifier body having a first end and a second end with an air passageway extending therebetween. The pacifier body defines a pacifier guard for preventing in use the infant from choking on or swallowing the pacifier. A nipple is disposed at the first end of the pacifier body. The nipple further includes an aperture formed therein to enable in use air communication between the mouth of the infant and the air passageway of the pacifier body. A sound generating means for directly generating a sound upon a flow of air therethrough is positioned at the second end of the pacifier body. The sound generating means is in air communication with the air passageway of the pacifier body. A one-way valve means inhibits in use the flow of air through the air passageway of the pacifier body and into the mouth of the infant when the infant sucks on the nipple and enables in use the expired air from the mouth of the infant to flow through the aperture of the nipple, the air passageway of the pacifier body, the one-way valve means and the sound generating means to exit the sound generating means thereby generating sound.

10 Claims, 1 Drawing Sheet

SOUND GENERATING PACIFIER

BACKGROUND OF THE INVENTION

1. Field of the Invention

This invention relates to infant pacifiers and more specifically, to a sound generating pacifier which directly generates sound to amuse an infant upon the infant expelling air into a sound generating means.

2. Information Disclosure Statement

Various types of pacifiers for an infant's mouth have been proposed in the prior art for pacifying infants or for example, utilizing a pacifier to incorporate a thermometer for measuring an infant's temperature.

Other prior art pacifiers or rattles have included some type of sound generating means for entertaining infants. One prior art device requires the infant to compress a self-inflating ball with his hand in order to produce a whistle sound. Another prior art device requires the infant to manipulate a piece of material to produce a cracking noise. Other prior art pacifiers have included an optional bell or ring to produce the amusing sound. These prior art pacifiers require the infant to shake or otherwise manipulate the pacifier with his hand in order to produce any audible noise.

Other prior art musical pacifiers have utilized an electronic circuit to produce audible sound when the infant slightly compresses the nipple portion. The problem with this type of prior art pacifier is that it requires a battery to power the electronic circuit that produces the audible sounds. Some small batteries may be toxic if the infant by chance swallows the battery. Another problem with this type of prior art pacifier is that the musical generating portion of the pacifier must be detached from the nipple portion to enable the nipple portion to be sterilized. This creates cleaning problems as well as the potential that the two parts of the pacifier could separate while being used by the infant.

It is a primary object of the invention to provide a sound generating pacifier for an infant's mouth that only requires the infant to exhale into the nipple portion to directly cause the sound generating means to produce musical sounds.

It is a further object of the invention to provide a sound generating pacifier for an infant's mouth that does not requiring any batteries or electronic means in order to generate sounds.

It is a further object of the invention to provide a sound generating pacifier for an infant's mouth that does not require the detachment of the sound generating means from the remainder of the pacifier in order to wash or otherwise sterilize the pacifier while at the same time not damaging the sound generating means.

It is a further object of the invention to provide a sound generating pacifier for an infant's mouth that offers the option of varying the sounds generated via the sound generating means.

It is a further object of the invention to provide a sound generating pacifier comprising a single piece.

The foregoing has outlined some of the more pertinent objects of the present invention. These objects should be construed to be merely illustrative of some of the more pertinent features and applications of the invention. Many other beneficial results can be obtained by applying the disclosed invention is a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The sound generating pacifier for an infant's mouth of the present invention is defined by the appended claims with specific embodiments shown in the attached drawings. For the purpose of summarizing the invention, the invention relates to a sound generating pacifier for an infant's mouth which comprises a pacifier body having a first end and a second end with an air passageway extending therebetween. The pacifier body defines a pacifier guard for preventing in use the pacifier from being completely drawn into the infant's mouth which may result in the infant choking on or swallowing the pacifier. A nipple is disposed at the first end of the pacifier body. The nipple further includes an aperture formed therein to enable in use air communication between the mouth of the infant and the air passageway of the pacifier body. A sound generating means for directly generating a sound upon a flow of air through the sound generating means is positioned at the second end of the pacifier body. The sound generating means being in air communication with the air passageway of the pacifier body. A one-way valve means inhibits in use the flow of air through the air passageway of the pacifier body and into the mouth of the infant when the infant sucks on the nipple and enables in use the expired air from the mouth of the infant to flow through the aperture of the nipple, the air passageway of the pacifier body, the one-way valve means and the sound generating means to exit the sound generating means thereby generating sound.

Preferably, the one-way valve means comprises a hinged member and a stop sealingly interposed in the air passageway of the pacifier body such that in use the hinged member is opened in response to the flow of air expired by the infant and the hinged member is sealingly closed against the stop upon the flow of air from the air passageway toward the mouth of the infant.

Preferably, the sound generating means comprises either a whistle or a tubular member with a plurality of slits formed therein for generating sound upon a flow of air therethrough. The tubular member includes a first end and a second end with the first end being secured to the second end of the pacifier body. A sliding ring is coaxially received on the tubular member for enabling in use a change in the sound of the notes generated by the sound generating means upon the sliding manipulation of the sliding ring between the first end and the second end of the tubular member to occlude partially or entirely the flow of air exiting at least one of the plurality of slits during the movement of air expired from the mouth of the infant.

Preferably, the second end of the tubular member includes a flange to prevent the sliding ring from being slidably removed from the second end of the tubular member.

The preferred embodiment of the invention includes a sound generating pacifier for an infant's mouth which comprises a pacifier body having a first end and a second end with an air passageway extending therebetween. The pacifier body defines a pacifier guard for preventing in use the infant from swallowing the pacifier. A nipple is disposed at the first end of the pacifier body. The nipple includes an aperture formed therein to enable in use air communication between the mouth of the infant and the air passageway of the pacifier body. A sound generating means for directly generating a sound upon a flow of air through the sound generating means is positioned at the second end of the pacifier body. The sound generating means is in air communication with the air passageway of the pacifier body and comprises a tubular member with a plurality of slits formed therein for generating sound upon a flow of air therethrough. The pitch of the sound generated by the movement of expelled air may be changed by occuding or partially occluding at least one slit of the plurality of slits. Also, a sliding ring may be coaxially received and positioned on the tubular member for enabling in use a change in the sound of the notes generated by the sound generating means upon the manipulation of the sliding means between the first end and the second end of the tubular member to occlude the flow of air exiting the plurality of slits during the movement of air expired from the mouth of the infant. A one-way valve means inhibits in use the flow of air through the air passageway of the pacifier body and into the mouth of the infant when the infant sucks on the nipple and enables in use the expired air from the mouth of the infant to flow through the aperture of the nipple, the air passageway of the pacifier body, the one-way valve means and the sound generating means to exit the sound generating means thereby generating sound. The one-way valve means comprises a hinged member and a stop sealingly interposed in the air passageway of the pacifier body such that in use the hinged member is opened in response to the flow of air expired by the infant and the hinged member is sealingly closed against the stop upon the flow of air from the air passageway toward the mouth of the infant.

Preferably, the second end of the tubular member includes a flange to prevent the sliding ring from being slidably removed from the second end of the tubular member.

In a further embodiment of the the sound generating pacifier for an infant's mouth comprises a pacifier body having a first end and a second end with an air passageway extending therebetween. The pacifier body defines a pacifier guard for preventing in use the infant from swallowing the pacifier. A nipple is disposed at the first end of the pacifier body. The nipple includes an aperture formed therein to enable in use air communication between the mouth of the infant and the air passageway of the pacifier body. A sound generating means for generating a sound upon a flow of air therethrough is positioned at the second end of the pacifier body. The sound generating means is in air communication with the air passageway of the pacifier body. The sound generating means comprises a whistle securably positioned at the second end of said pacifier body. A one-way valve means inhibits in use the flow of air through the air passageway of the pacifier body and into the mouth of the infant when the infant sucks on the nipple and enables in use the expired air from the mouth of the infant to flow through the aperture of the nipple, the air passageway of the pacifier body, the one-way valve means and the whistle to exit the whistle thereby generating sound.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
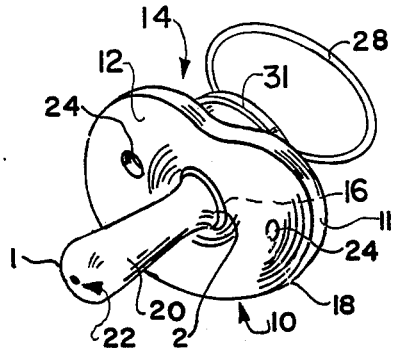
FIG. 1 is a front isometric view of the invention.

FIG. 1 is an isometric view of the invention 10 showing the pacifier body 11 having a first end 12 and a second end 14 with an air passageway 16 formed in the pacifier body 11. The air passageway 16 extends between the first end 12 and the second end 14 of the pacifier body 11. A pacifier guard 18 is defined by the pacifier body 11. The pacifier guard 18 is configured to prevent the pacifier 10 from entering an infants mouth and blocking the airway. A nipple 20 is disposed at the first end 12 of the pacifier body 11. The nipple 20 has a tip 1 and a base 2. The tip 1 of the nipple 20 enters the infant's mouth. The base 2 of nipple 20 is securely positioned at the first end 12 of the pacifier guard 18. The nipple 20 is hollow and has an aperture 22 formed therein to enable the passage of expired air therethrough. Aperture 22 of nipple 20 is in air communication with the air passageway 16 of the pacifier body 11 and with the infant's mouth when positioned in use. Ventilation holes 24 are formed in pacifier guard 18. In the event the entire pacifier enters the infant's mouth, the ventilation holes 24 may be used to provide an emergency oxygen supply to the infant as well as provide a means to aid in removal of the pacifier. Ring member 28 is positioned at the second end 27 of the tubular member 25. Ring member 28 lessens the desirably of inserting of the second end 27 of the tubular member 25 into the mouth of the infant. Ring member 28 further provides a handle which may be easily grasped for removing the pacifier 10 from the infant's mouth or inserting the nipple 20 of the pacifier 10 into the infant's mouth. The ring 28 is hinged and is free to pivot such that in use the ring does not protrude perpendicularly relative to flange 31.

Figure 2:
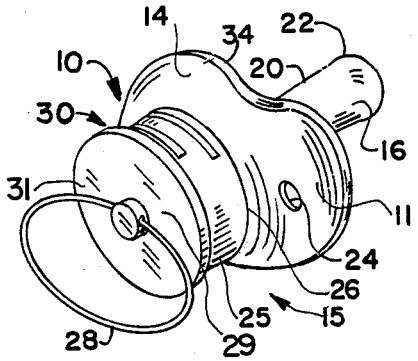
FIG. 2 is a rear isometric view of the invention.

FIG. 2 is an isometric view of the invention showing the air-activated sound generating means 30 positioned at the second end 14 of the pacifier body 11. The air-activated sound generated means 30 mechanically produces a sound upon a flow of air therethrough. Such mechanical sound generating means activated by air include a whistle(s) 13 or flute type 15 instruments known in the art. The air-activated sound generating means 30 may resemble a shortened version of a musical flute in design and extends from the pacifier guard 18 on the second end 14 of the pacifier body 11 which is also opposite the positioning of the nipple 20. This enables a one-way valve means to be positioned in the pacifier body 11 between the sound generating means 30 and the nipple 20. Ring member 28 is positioned at the second end 27 of the tubular member 25 such that in use the ring member 28 does not outwardly protrude from flange 31. An outward protrusion of the ring member 28 would possibly aggravate the fall of an infant by increasing the force that the pacifier is pushed into the infant's mouth. The occlusion of a slit 35 of the plurality of slits 32 is accomplished by manipulating the sliding ring 34 to cover or partially cover at least one slit 35 of the plurality of slits 32.

Figure 3:
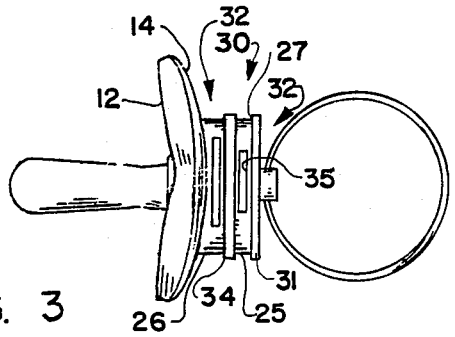
FIG. 3 is a top plan view of the invention.

FIG. 3 is a top plan view illustrating the plurality of slits 32 of the air-activated sound generating means 30 to be of varying sizes for permitting different musical sounds to be produced upon the flow of air therethrough. The tubular member 25 includes a first end 26 and a second end 27 with the first end 26 being secured to the second end 14 of the pacifier body 11. The second end 27 of the tubular member 25 includes a flange 31 extending radially from the tubular member 25 to prevent the sliding ring 34 from being slidably removed from the second end 27 of the tubular member 25.

Figure 4:
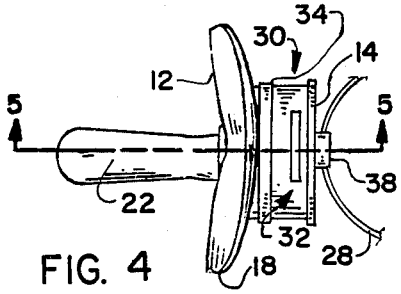
FIG. 4 is a top plan view of the invention with an occluded slit.

FIG. 4 illustrates sliding ring 34 coaxially positioned on the tubular member 25 and occluding one of the slits of the plurality of slits 32. The sliding ring 34 is configured to cover at least one of the plurality of slits 32. Sliding ring 34 may be manipulated in use by a person to allow a variety of different notes to be produced by the air-activated sound generating means 30.

Figure 5:
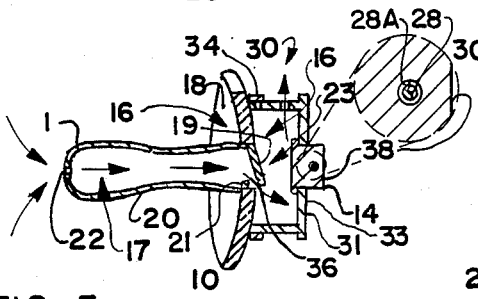
FIG. 5 is a cross-section view of the invention along line 5—5 of FIG. 4.

FIG. 5 is a sectional view illustrating the aperture 22 of nipple 20 which is preferably formed in the tip 1 of the nipple 20. The air 17 leads from the nipple aperture 22 to the one-way valve means 36, shown here with hinged member 19 in the open position 23, and into the the air-activated sound generating means 30 whereupon the air exits the plurality of slits 32 formed in the tubular member 25 simultaneously generating musical sounds. Sliding ring 34 is coaxially received on the tubular member 25 and slides between the first end 26 and the second end 27 of the tubular member 25. The terminal portion 33 of the second end 27 of tubular member 25 includes a boss 38 with an aperture 28A formed therein to receive ring member 28. The aperture 28A enables member 28, such as a handle, to freely pivot.

Figure 6:
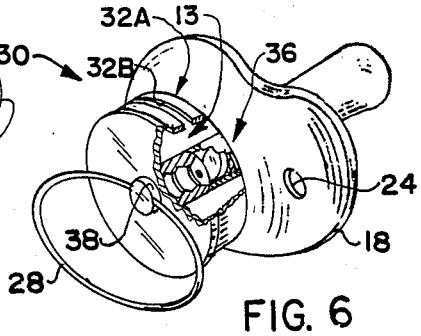
FIG. 6 is an enlarged plan view of another embodiment of the invention.

FIG. 6 is a rear isometric view of another embodiment of the invention illustrating a whistle 13 attached to the second end 14 of the pacifier body 11 in front of the one-way valve means 36.

Figure 7:
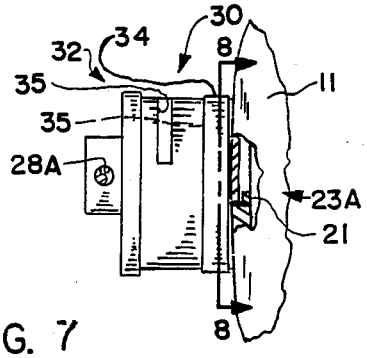
FIG. 7 is an enlarged side view of the invention with a portion cut away.

FIG. 7 is an enlarged side view of the invention with a cut-away revealing a cross-section of the one-way valve means 36 with its hinged member 16 in a closed position 23A against the stop 21.

Figure 8:
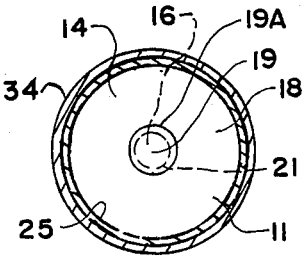
FIG. 8 is a cross-section taken along lines 8—8 of FIG. 7

FIG. 8 is a cross-section taken along lines 8—8 of FIG. 7 showing the hinge member 19 hingedly secured by a hinge 19A. Hinge member 19 is sealingly secured against stop 21 when in use the infant is sucking on the nipple 20.

In operation of the present invention the infant forces air through the aperture 22 of the nipple 20 and into the air passageway 16 of the pacifier body 11, thereby opening the hinged member 19 of one-way valve means 36 into an open position 23 enabling the forced air to continue flowing through the air passageway 16 and out the plurality of slits 32 of the air-activated sound generating means 30 thereby producing musical sounds as illustrated at FIG. 5. When the infant begins to suck on the nipple 20, the hinged member 19 is forced against stop 21 because of the difference in pressure between the mouth cavity of the infant and the pressure external to the pacifier. With the pressure being lower in the cavity of the mouth, hinged member 19 is forced by the higher air pressure external to the pacifier causing the hinge member 19 to swing shut 23A against stop 21 thereby stopping the flow of air therethrough as illustrated at FIG. 7. Thus, the one-way valve means 36 prevents the infant from swallowing air when the infant sucks on the nipple 20 thereby keeping unwanted air out of the infant's stomach. When the infant expels or blows air into the nipple 20, via the nipple aperture 22 the air flows through the air passageway 16 pushing the hinged member 19 of one-way valve means 36 open which allows the expelled air to flow into the air-activated sound generating means 30. The expelled air 17, upon exiting from the plurality of slits 32 of the air-activating sound generating means 30 produces sound designed to amuse and entertain the infant. A further embodiment of the invention has a sliding ring 34 coaxially positioned on the tubular member 25 of the air-activated sound generating means 30 to enable a person to slide the sliding ring 34 between the first end 26 and the second end 27 of the tubular member 25 to cover or partially cover at least one of the plurality of slits 32 in the air-activating sound generating means thereby changing the sound produced when the expelled air 17 exits through the plurality of slits 32 of the air-activated sound generating means 30. The second end 27 of the tubular member 25 to prevent the sliding ring 34 from being slidably removed from the second end 27 of the tubular member 25. Flange 31 reduces the chance that the infant would be able to remove the sliding ring 34 and swallow it.

In a further embodiment of the invention, the air-activated sound generating means 30 is a whistle 13 as illustrated at FIG. 6. In operation of this embodiment the infant forces air through the aperture 22 of the nipple 20 and into the air passageway 16 of the pacifier body 11, thereby opening the hinged member 19 of one-way valve means 36 into an open position 23 enabling the forced air to continue flowing through the air passageway 16 and through the whistle 13 and out an opening 32A such as slit 32B thereby producing musical sounds.

The present disclosure includes that contained in the appended claims as well a that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A sound generating pacifier for an infant's mouth comprising:

a pacifier body having a first end and a second end with an air passageway extending therebetween;

said pacifier body defining a pacifier guard for preventing in use the infant from completely drawing the pacifier into the infant's mouth;

a nipple disposed at said first end of said pacifier body;

said nipple further including an aperture formed therein to enable in use air communication between the mouth of the infant and said air passageway of said pacifier body;

a sound generating means for directly generating a sound upon a flow of air through said sound generating means positioned at said second end of said pacifier body;

said sound generating means being in air communication with said air passageway of said pacifier body; and a one-way valve means positioned in said air passageway of said pacifier body for inhibiting in use the flow of air through said air passageway of said pacifier body and into the mouth of the infant when the infant sucks on the nipple and for enabling in use expired air from the mouth of the infant to flow through said aperture of said nipple, said air passageway of said pacifier body, said one-way valve means and said sound generating means to exit said sound generating means thereby generating sound.

2. The pacifier of claim 1 wherein said one-way valve means comprises a hinged member and a stop sealingly interposed in said air passageway of said pacifier body such that in use said hinged member is opened in response to the flow of air expired by the infant and said hinged member is sealingly closed against said stop upon the flow of air from said air passageway toward the mouth of the infant.

3. The pacifier of claim 1 wherein said sound generating means comprises a whistle.

4. The pacifier of claim 1 wherein said sound generating means comprises a tubular member with a plurality of slits formed therein for generating sound upon a flow of air therethrough.

5. The pacifier of claim 4 wherein said sound generating means further includes a sliding ring coaxially positioned on said tubular member for enabling in use a change in the sound of the notes generated by said sound generating means upon the manipulation of said sliding means to occlude the flow of air exiting said plurality of slits during the movement of air expired from the mouth of the infant.

6. The pacifier of claim 5 wherein said tubular member includes a first end and a second end with said first end being secured to said second end of said pacifier body; and said second end of said tubular member including a flange to prevent said sliding ring from being slidably removed from said second end of said tubular member.

7. A sound generating pacifier for an infant's mouth comprising:

a pacifier body having a first end and a second end with an air passageway extending therebetween;

said pacifier body defining a pacifier guard for preventing in use the infant from completely drawing the pacifier into the infant's mouth;

a nipple disposed at said first end of said pacifier body;

said nipple further including an aperture formed therein to enable in use air communication between the mouth of the infant and said air passageway of said pacifier body;

a sound generating means for directly generating a sound upon a flow of air through said sound generating means positioned at said second end of said pacifier body;

said sound generating means being in air communication with said air passageway of said pacifier body and comprises a tubular member with a plurality of slits formed therein for generating sound upon a flow of air therethrough;

a one-way valve means positioned in said air passageway of said pacifier body for inhibiting in use the flow of air through said air passageway of said pacifier body and into the mouth of the infant when the infant sucks on the nipple and for enabling in use expired air from the mouth of the infant to flow through said aperture of said nipple, said air passageway of said pacifier body, said one-way valve means and said sound generating means to exit said sound generating means thereby generating sound; and said one-way valve means comprising a hinged member and a stop sealingly interposed in said air passageway of said pacifier body such that in use said hinged member is opened in response to the flow of air expired by the infant and said hinged member is sealingly closed against said stop upon the flow of air from said air passageway toward the mouth of the infant.

8. The pacifier of claim 7 wherein said sound generating means further includes a sliding ring coaxially positioned on said tubular member for enabling in use a change in the sound of the notes generated by said sound generating means upon the manipulation of said sliding means to occlude the flow of air exiting said plurality of slits during the movement of air expired from the mouth of the infant.

9. The pacifier of claim 8 wherein said tubular member includes a first end and a second end with said first end being secured to said second end of said pacifier body; and said second end of said tubular member including a flange to prevent said sliding ring from being slidably removed from said second end of said tubular member.

10. A sound generating pacifier for an infant's mouth comprising:

a pacifier body having a first end and a second end with an air passageway extending therebetween;

said pacifier body defining a pacifier guard for preventing in use the infant from completely drawing the pacifier into the infant's mouth;

a nipple disposed at said first end of said pacifier body;

said nipple further including an aperture formed therein to enable in use air communication between the mouth of the infant and said air passageway of said pacifier body;

a sound generating means for directly generating a sound upon a flow of air through said sound generating means positioned at said second end of said pacifier body;

said sound generating means being in air communication with said air passageway of said pacifier body;

said sound generating means comprises a whistle; and a one-way valve means positioned in said air passageway of said pacifier body for inhibiting in use the flow of air through said air passageway of said pacifier body and into the mouth of the infant when the infant sucks on the nipple and for enabling in use expired air from the mouth of the infant to flow through said aperture of said nipple, said air passageway of said pacifier body, said one-way valve means and said whistle to exit said whistle thereby generating sound.

* * * * *

UNITED STATES PATENT AND TRADEMARK OFFICE

CERTIFICATE OF CORRECTION

PATENT NO. : 4,856,519

DATED : August 15, 1989

INVENTOR(S) : Leonides Y. Teves

It is certified that error appears in the above-identified patent and that said Letters Patent is hereby corrected as shown below:

In the Specification

Column 6, line 41, after "25" insert missing line --includes a flange 31 which extends radially from the tubular member 25--.

Signed and Sealed this

Third Day of July, 1990

*Attest:*

HARRY F. MANBECK, JR.

*Attesting Officer*

*Commissioner of Patents and Trademarks*